US011639644B2

(12) United States Patent
Wood et al.

(10) Patent No.: US 11,639,644 B2
(45) Date of Patent: May 2, 2023

(54) DOWNHOLE FLOW COMMUNICATION APPARATUSES

(71) Applicant: 8Sigma Energy Services Incorporated, Calgary (CA)

(72) Inventors: Blake Wood, Calgary (CA); Rodney Schnel, Calgary (CA); Nigel Dabreo, Calgary (CA)

(73) Assignee: 8Sigma Energy Services Incorporated, Calgary (CA)

( * ) Notice: Subject to any disclaimer, the term of this patent is extended or adjusted under 35 U.S.C. 154(b) by 184 days.

(21) Appl. No.: 17/139,531

(22) Filed: Dec. 31, 2020

(65) Prior Publication Data

US 2021/0215015 A1 Jul. 15, 2021

Related U.S. Application Data

(60) Provisional application No. 62/959,411, filed on Jan. 10, 2020.

(51) Int. Cl.

| | |
|---|---|
| ***E21B 43/12*** | (2006.01) |
| ***E21B 33/12*** | (2006.01) |
| ***E21B 34/06*** | (2006.01) |

(52) U.S. Cl.

CPC ..... *E21B 33/12* (2013.01); *E21B 34/06* (2013.01); *E21B 34/063* (2013.01); *E21B 43/12* (2013.01); *E21B 2200/08* (2020.05)

(58) Field of Classification Search

CPC ..... E21B 33/12; E21B 34/06; E21B 2200/08; E21B 34/063; E21B 43/12

See application file for complete search history.

(56) References Cited

U.S. PATENT DOCUMENTS

| | | | | |
|---|---|---|---|---|
| 5,355,956 | A * | 10/1994 | Restarick | E21B 43/11 166/229 |
| 8,851,190 | B1 * | 10/2014 | Lopez | E21B 34/08 166/325 |
| 2008/0169099 | A1 * | 7/2008 | Pensgaard | E21B 33/138 166/285 |
| 2009/0101330 | A1 * | 4/2009 | Johnson | E21B 34/063 166/270 |
| 2009/0101349 | A1 * | 4/2009 | Johnson | E21B 34/063 166/183 |
| 2009/0101357 | A1 * | 4/2009 | Johnson | E21B 43/08 166/115 |

(Continued)

*Primary Examiner* — Steven A Macdonald

(74) *Attorney, Agent, or Firm* — Ridout & Maybee LLP

(57) ABSTRACT

There is provided a fluid flow conducting apparatus comprising: a housing, a housing passage configured for conducting fluid through the housing, and a flow controller for controlling flow communication between the housing passage and an environment external to the housing. The flow controller includes a sealed interface-effector. The flow controller is disposed in a first configuration, and adapted for disposition in a second configuration in response to disposition of the sealed interface-effector in communication with a degradation-promoting agent such that degradation of the sealed interface effector is effected. In the first configuration, the sealed interface effector is threadably coupled to the housing and defines a sealed interface between the housing passage and the environment external to the housing. In the second configuration, the sealed interface is defeated.

34 Claims, 5 Drawing Sheets

(56) References Cited

U.S. PATENT DOCUMENTS

| | | | | |
|---|---|---|---|---|
| 2011/0297393 | A1* | 12/2011 | Patel | E21B 34/08 166/325 |
| 2012/0305243 | A1* | 12/2012 | Hallundbæk | E21B 43/12 166/334.4 |
| 2014/0020898 | A1* | 1/2014 | Holderman | E21B 43/12 166/229 |
| 2014/0262207 | A1* | 9/2014 | Lopez | E21B 43/12 166/114 |
| 2017/0254174 | A1* | 9/2017 | Least | E21B 34/10 |
| 2018/0328139 | A1* | 11/2018 | Mhaskar | E21B 34/063 |

* cited by examiner

DOWNHOLE FLOW COMMUNICATION APPARATUSES

CROSS-REFERENCE TO RELATED APPLICATION

This application is claims the benefit of priority to U.S. Provisional Patent Application No. 62/959,411, filed Jan. 10, 2020, titled DOWNHOLE FLOW COMMUNICATION APPARATUSES, the contents of which are hereby expressly incorporated into the present application by reference in their entirety.

FIELD

The present disclosure relates to flow injection apparatuses for use downhole for injecting fluid into a subterranean formation.

BACKGROUND

Simulating and receiving production of fluid from a subterranean formation requires selectively effecting flow communication between the surface and the subterranean formation via downhole valves. It is desirable to avoid deploying tools downhole to actuate the creation of such flow communication.

SUMMARY

In one aspect, there is provided a fluid flow conducting apparatus comprising:
a housing;
a flow communicator disposed on an external surface of the housing;
a housing passage configured for conducting fluid through the housing;
a communication passage extending through the housing from the flow communicator to the housing passage; and
a flow controller for controlling flow communication, via the flow communicator, between the housing passage and an environment external to the housing, and including a sealed interface-effector disposed within the communication passage;
wherein:
the flow controller is disposed in a first configuration, and adapted for disposition in a second configuration in response to disposition of the sealed interface-effector in communication with a degradation-promoting agent such that degradation of the sealed interface effector is effected;
in the first configuration, the sealed interface effector defines a sealed interface between the housing passage and the environment external to the housing; and
in the second configuration, the sealed interface is defeated.

In another aspect, there is provided a fluid flow conducting apparatus comprising:
a housing;
a flow communicator disposed on an external surface of the housing;
a housing passage configured for conducting fluid through the housing;
a communication passage extending through the housing from the flow communicator to the housing passage; and
a plug disposed within the communication passage such that the communication passage is disposed in a closed condition;

wherein:
the plug is degradable; and
the plug and the communication passage are co-operatively configured such that, in response to degradation of the plug, the communication passage becomes disposed in an open condition.

In another aspect, there is provided a fluid flow conducting apparatus comprising:
a housing;
a housing passage configured for conducting fluid through the housing; and
a flow controller for controlling flow communication between the housing passage and an environment external to the housing;
wherein:
the flow controller includes a sealed interface-effector;
the flow controller is disposed in a first configuration, and adapted for disposition in a second configuration in response to disposition of the sealed interface-effector in communication with a degradation-promoting agent such that degradation of the sealed interface effector is effected;
in the first configuration, the sealed interface effector is threadably coupled to the housing and defines a sealed interface between the housing passage and the environment external to the housing; and
in the second configuration, the sealed interface is defeated.

In another aspect, there is provided a fluid flow conducting apparatus comprising:
a housing;
a housing passage configured for conducting fluid through the housing; and
a plug threadably coupled to the housing;
wherein:
the plug is degradable; and
the plug and the housing co-operatively configured such that, in response to degradation of the plug, a communicating passage, extending through the housing, is established, and effects flow communication between the housing passage and an environment external to the housing.

In another aspect, there is provided a fluid flow conducting apparatus comprising:
a housing;
a housing passage configured for conducting fluid through the housing; and
a flow controller for controlling flow communication between the housing passage and an environment external to the housing, and including a sealed interface-effector and a one-way valve;
wherein:
the flow controller is disposed in a first configuration, and adapted for disposition in a second configuration in response to disposition of the sealed interface-effector in communication with a degradation-promoting agent such that degradation of the sealed interface effector is effected;
in the first configuration, the sealed interface effector defines a sealed interface between the housing passage and the environment external to the housing; and
in the second configuration: (i) the sealed interface is defeated, (ii) fluid flow is conductible from the housing passage to the environment external to the housing, and (iii) the one-way valve is effective for preventing fluid flow from the environment external to the housing to the housing passage.

In another aspect, there is provided a fluid flow conducting apparatus comprising:
a housing;
a flow communicator disposed on an external surface of the housing;

a housing passage configured for conducting fluid through the housing;

a communication passage extending through the housing from the flow communicator to the housing passage; and within the communication passage, a plug and a one-way valve;

wherein:

the plug is disposed between the housing passage and the one-way valve; and the plug is degradable.

BRIEF DESCRIPTION OF DRAWINGS

The preferred embodiments will now be described with the following accompanying drawings, in which.

DETAILED DESCRIPTION

The present disclosure provides apparatuses and systems that can be used in well completion for enabling selective flow communication between a wellbore 102 and a subterranean formation 100.

Figure 1:
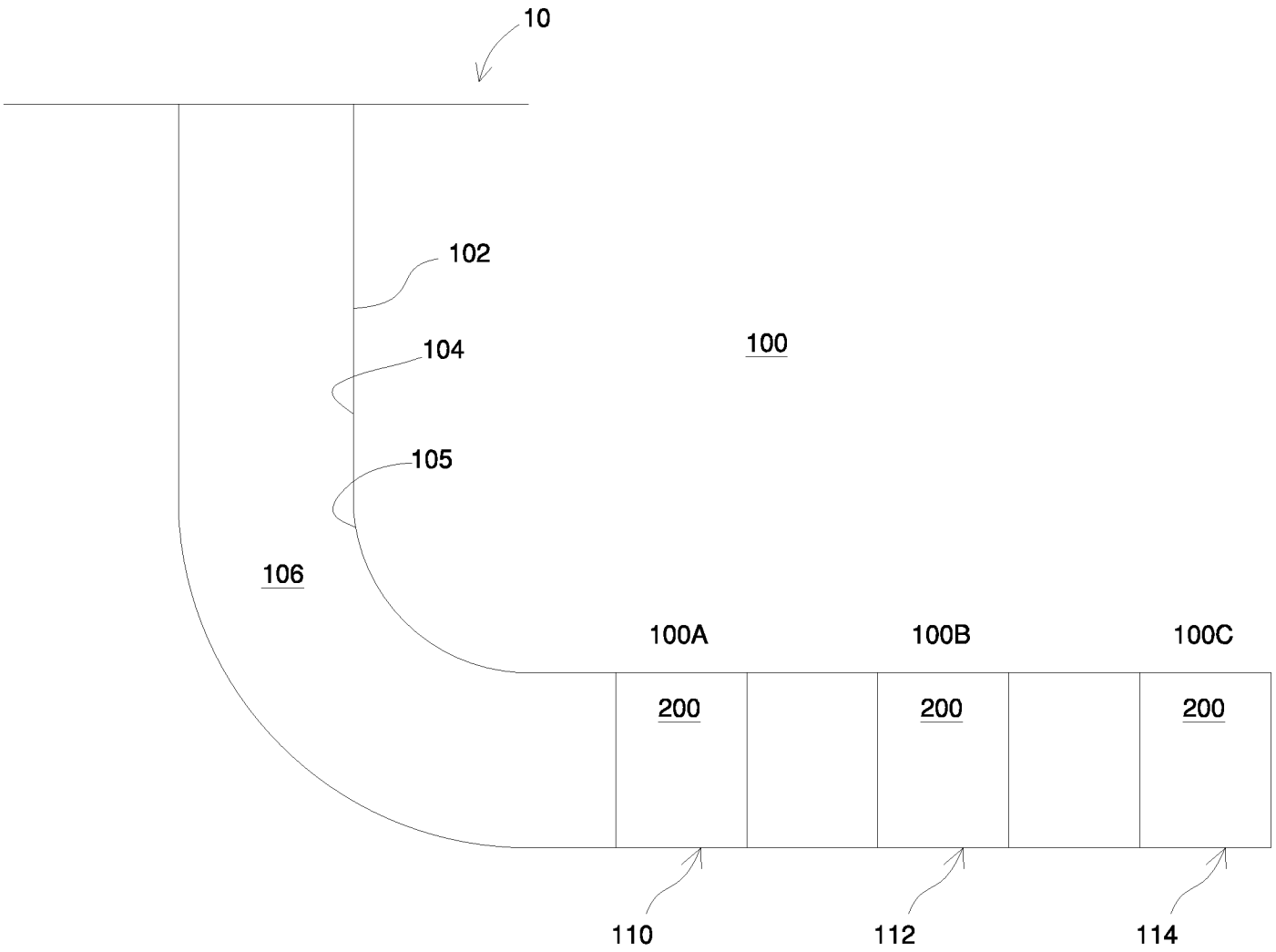
FIG. 1 is a schematic illustration of a system for effecting flow communication between the surface and a subterranean formation via a wellbore.

Referring to FIG. 1, there is provided a wellbore material transfer system for conducting (e.g. flowing) material from the surface 10 to a subterranean formation 100 via a wellbore 102. In some embodiments, for example, the subterranean formation 100 is a hydrocarbon material-containing reservoir.

The wellbore 102 can be straight, curved, or branched. The wellbore 102 can have various wellbore sections. A wellbore section is an axial length of a wellbore 102. A wellbore section can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

In some embodiments, for example, the conducting includes conducting of fluid flow for enabling the downhole deployment of tools. In some embodiments, for example, the conducting includes conducting of treatment material from the surface 10 to the subterranean formation 100 for stimulating the subterranean formation 100 for production of the reservoir fluid.

In some embodiments, for example, the conducting (such as, for example, by flowing) treatment material to the subterranean formation 100 via the wellbore 102 is for effecting selective stimulation of the subterranean formation 100, such as a subterranean formation 100 including a hydrocarbon material-containing reservoir. The stimulation is effected by supplying the treatment material to the subterranean formation 100. In some embodiments, for example, the treatment material includes a liquid, such as a liquid including water. In some embodiments, for example, the liquid includes water and chemical additives. In other embodiments, for example, the stimulation material is a slurry including water and solid particulate matter, such as proppant. In some embodiments, for example the treatment material includes chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir.

In some embodiments, for example, the conducting of fluid, to and from the wellhead, is effected via a wellbore string 104. The wellbore string 104 may include pipe, casing 105, or liner, and may also include various forms of tubular segments. The wellbore string 104 defines a wellbore string passage 106 for effecting conduction of fluids between the surface 10 and the subterranean formation 100.

In some embodiments, for example, the wellbore 102 includes a cased-hole completion, in which case, the wellbore string 104 includes a casing 105.

A cased-hole completion involves running casing 105 down into the wellbore 102 through the production zone. The casing 105 at least contributes to the stabilization of the subterranean formation 100 after the wellbore 102 has been completed, by at least contributing to the prevention of the collapse of the subterranean formation 100 that is defining the wellbore 102. In some embodiments, for example, the casing 105 includes one or more successively deployed concentric casing 105 strings, each one of which is positioned within the wellbore 102, having one end extending from the well head. In this respect, the casing 105 strings are typically run back up to the surface. In some embodiments, for example, each casing 105 string includes a plurality of jointed segments of pipe. The jointed segments of pipe typically have threaded connections.

In some embodiments, for example, the annular region between the casing 105 and the subterranean formation 100 is filled with cement for effecting zonal isolation. The cement is disposed between the casing 105 and the subterranean formation 100 for the purpose of effecting isolation, or substantial isolation, of one or more zones of the subterranean formation from fluids disposed in another zone of the subterranean formation. Such fluids include formation fluid being produced from another zone of the subterranean formation 100 (in some embodiments, for example, such formation fluid being flowed through a production string disposed within and extending through the casing 105 to the surface), or injected stimulation material. In some embodiments, for example, the cement also provides one or more of the following functions: (a) strengthens and reinforces the structural integrity of the wellbore, (b) prevents, or substantially prevents, produced formation fluids of one zone from being diluted by water from other zones. (c) mitigates corrosion of the casing 105, and (d) at least contributes to the support of the casing 105. The zonal isolation material is introduced to an annular region between the casing 105 and the subterranean formation 100 after the subject casing 105 has been run into the wellbore 102. In some embodiments, for example, the zonal isolation material includes cement.

To effect flow communication between the wellbore 102 and the subterranean formation 100, one or more flow communication stations (three flow communication stations 110, 112, 114 are illustrated) are emplaced at the interface between the subterranean formation 100 and the wellbore 102. Successive flow communication stations 110, 112, 114 may be axially spaced from each other along the wellbore 102. In some embodiments, for example, the spacing is such that each one of the flow communication stations 110, 112, 114, independently, is positioned adjacent a zone or interval of the subterranean formation 100 for effecting flow communication between the wellbore 102 and the zone (or interval).

In some embodiments, for example, the conducting of fluid flow between the surface 10 and the subterranean formation 100, is effected through the passage 106 of the wellbore string 104 via the one or more flow communication stations 110, 112, 114.

In some of these embodiments, for example, the fluid being conducted is conducted downhole, from the surface 10 and to the subterranean formation 100. In those embodiments where the fluid is being conducted downhole, in some of these embodiments, for example, the conducted fluid includes fluid that is urging deployment of downhole tools. In some of these embodiments, for example, the conducted fluid includes treatment material, such that the fluid being conducted is for stimulating production of hydrocarbons from the subterranean formation 100.

In some embodiments, for example, the fluid being conducted is conducted uphole, from the subterranean formation 100 to the surface 10. In this respect, in some of these embodiments, for example, the conducted fluid includes produced hydrocarbons.

In those embodiments where fluid is being conducted downhole from the surface 10 to the subterranean formation 100, in some of these embodiments, for example, to effect flow communication between the surface 10 and the subterranean formation for enabling the conducting of the fluid from the surface 10 to the subterranean formation 100, one or more of the flow communication stations 110, 112, 114 are provided for at least injecting the fluid into the subterranean formation. Each one of the flow communication stations 110, 112, 114, independently, corresponds to a respective zone 100A, 100B, 100C of the subterranean formation 100.

Each one of the one or more flow communication stations 110, 112, 114 includes one or more flow communication apparatuses 200. The flow communication apparatus 200 is configured for integration within the wellbore string 104. The integration may be effected, for example, by way of threading or welding. In some embodiments, for example, the integration is by threaded coupling, and, in this respect, in some embodiments, for example, each one of the uphole and downhole ends, independently, is configured for such threaded coupling to other portions of the wellbore string 104. In some embodiments, for example, the flow communication apparatus 200 is a wellbore sub. In some embodiments, for example, the flow communication apparatus 200 is integrated within the wellbore string, and the integration is with effect that a toe sleeve is defined.

Referring to FIGS. 2 to 10, suitable flow communication apparatuses 200 include flow communication apparatuses 200A, 200B, 200C, or 200D.

Referring to FIGS. 2 to 7, the flow communication apparatus 200 includes a housing 210. The housing 202 includes a housing passage 230. In some embodiments, for example, the housing 202 includes an uphole port 201A at an uphole end of the apparatus 200, and a downhole port 201B at a downhole end of the apparatus 200, and the housing passage 230 extends between the uphole and downhole flow ports 201A, 201B. The flow communication apparatus 200 is configured for integration within the wellbore string 104 such that the wellbore string passage 106 includes the passage 230. The integration may be effected, for example, by way of threading or welding. In some embodiments, for example, the integration is by threaded coupling, and, in this respect, in some embodiments, for example, each one of the uphole and downhole ends, independently, is configured for such threaded coupling to other portions of the wellbore string 104.

Referring to FIGS. 2 to 10, the flow communication apparatus 200 includes a flow controller 220 for controlling flow communication between the housing passage 230 and an environment external to the housing 210.

Figure 2:
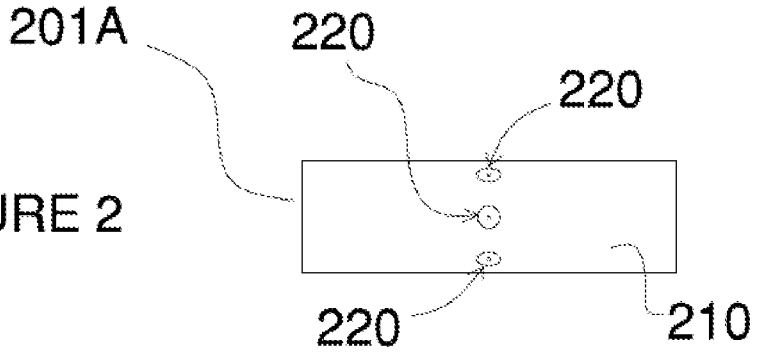
FIG. 2 is a side view of the embodiment of a flow communication apparatus for use in the system illustrated in FIG. 1, illustrating the flow controller in the first configuration.
Figure 3:
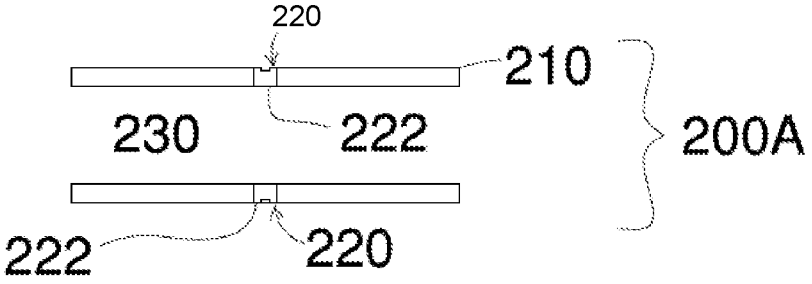
FIG. 3 is a side sectional view of the embodiment of the flow injection apparatus illustrated in FIG. 2, illustrating the flow controller in the first configuration.
Figure 4:
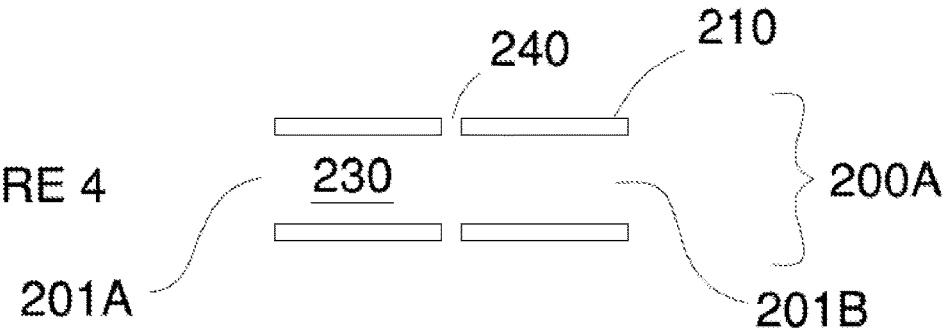
FIG. 4 is a side sectional view of the embodiment of the flow injection apparatus illustrated in FIG. 2, illustrating the flow controller in the second configuration.
Figure 5:
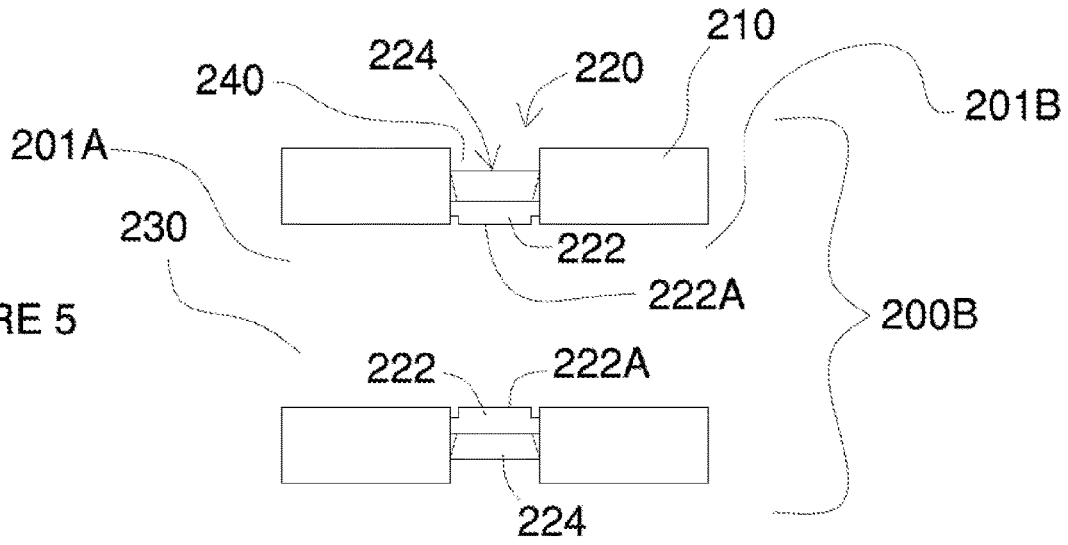
FIG. 5 is a side sectional view of another embodiment of a flow communication apparatus for use in the system illustrated in FIG. 1, illustrating the flow controller in the first configuration.

Referring to FIGS. 2 to 4, the flow controller 220 includes a sealed interface-effector 222.

With respect to the embodiment illustrated in FIGS. 2 to 4, the apparatus is configured to transition from a first configuration (see FIG. 3) to a second configuration (see FIG. 4). While the apparatus 200 is disposed in the first configuration, the sealed interface effector 222 defines a sealed interface 222A between the housing passage 230 and the environment external to the housing 210 (i.e. the subterranean formation 100).

While the apparatus 200 is disposed in the second configuration, the sealed interface 222A is defeated. In some embodiments, for example, the defeating of the sealed interface 222A is with effect that flow communication is established between the housing passage 230 and the environment external to the housing 210.

It is understood that, with respect to the sealed interface 222A, although some leakage across the sealed interface 222A may be effectible, the rate of such leakage is sufficiently small so as not to adversely affect stimulation or production processes.

With respect to the embodiment illustrated in FIGS. 2 to 4, the apparatus 200 is transitionable from the first configuration to the second configuration in response to disposition of the sealed interface-effector 222 in communication with a degradation-promoting agent. In this respect, while the apparatus 200 is disposed in the first configuration, the housing 210 and the sealed interface effector 222 are co-operatively configured such that the sealed interface 222A, defined by the sealed interface effector 222, is defeatable in response to disposition of the sealed interface-effector 222 in communication with a degradation-promoting agent, with effect that the apparatus 200 becomes disposed in the second configuration. In some embodiments, for example, the degradation-promoting agent is a chemical agent, such as, for example, an acid. In response to disposition of the sealed interface-effector 222 in communication with the degradation-promoting agent, degradation of the sealed interface effector 222 is effected. In this respect, in some embodiments, for example, the sealed interface-effector 222 includes degradable material, and the degradation of the sealed interface effector 222 includes degradation of the degradable material, and the degradation is effected by, for example, at least one of dissolution and chemical conversion. In some embodiments, for example, the degradable material is a dissolvable metal material. In some embodiments, for example, the degradable material includes at least one of aluminium and magnesium. In some embodiments, for example, the degradable material is degradable in response to contact with wellbore fluid, and, in this respect, the degradation-promoting agent is the wellbore fluid. In some embodiments, for example, the disposition of the sealed interface-effector 222 in communication with a degradation-promoting agent is effected by conducting the degradation-promoting agent downhole, from the surface 10, via the passage 106 of the wellbore string 104. In this respect, in such embodiments, for example, the apparatus 200 is transitionable from the first configuration to the second configuration in response to disposition of the sealed interface-effector 222 in communication with a degradation-promoting agent emplaced within the housing passage 230.

With respect to the embodiment illustrated in FIGS. 2 to 4, in some embodiments, for example, while the apparatus 200 is disposed in the first configuration, the housing 210 and the sealed interface effector 222 are co-operatively configured such that defeating of the sealed interface, defined by the sealed interface effector 222, in response to exceeding of fluid pressure, in the environment external to the housing 210, by fluid pressure within the housing passage 230, is only effectible when the exceeding is by at least a minimum pressure differential, and the minimum pressure differential is at least 4,000 psi. Below the minimum pressure differential, there is an absence of defeating of the sealed interface, defined by the sealed interface effector 222, in response to exceeding of fluid pressure, in the environment external to the housing 210, by fluid pressure within the housing passage 230.

In some embodiments, for example, the sealed interface effector 222 is defined by a plug that is disposed within a communication passage 240, extending through the housing 210, from a flow communicator 220 (defined by, for example, a port), disposed on an external surface of the housing 210, to the housing passage 230. In some embodiments, for example, the plug 222 is received within the communication passage 240. In some embodiments, for example, the plug 222 is threadably coupled to the housing 210 within the communication passage 240. In some embodiments, for example, the plug 222 has a yield strength of at least 20,000 psi, such as, for example, at least 30,000 psi, such as, for example, at least 40,000 psi. In some embodiments, for example, the communication passage 240 has a maximum cross-sectional area of less than 50 square inches, such as, for example, less than 28 square inches.

In some embodiments, for example, the plug 222 is co-operatively disposed relative to the communication passage 240 such that the communication passage 240 is disposed in the closed condition. In response to degradation of the plug 222, the communication passage 240 becomes disposed in the open condition.

Referring to FIGS. 5 to 10, in some embodiments, for example, the flow controller 220 includes the sealed interface-effector 222 and a one-way valve 224.

Figure 6:
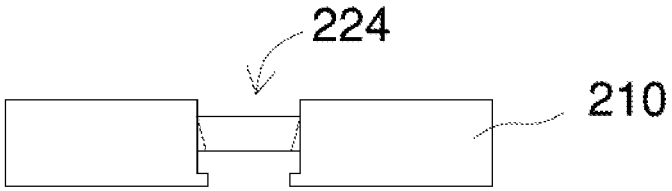
FIG. 6 is a partial side sectional view of the embodiment of the flow injection apparatus illustrated in FIG. 5, illustrating the flow controller in the second configuration, while the one-way valve is preventing fluid flow from an environment external to the apparatus to the housing passage.
Figure 7:
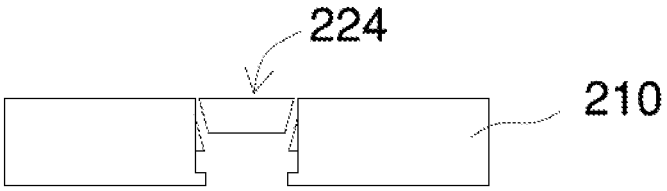
FIG. 7 is a partial side sectional view of the embodiment of the flow injection apparatus illustrated in FIG. 5, illustrating the flow controller in the second configuration, while the one-way valve is disposed in an open condition in response to fluid pressure within the housing passage exceeding fluid pressure within the environment external to the apparatus.

With respect to the embodiments illustrated in FIGS. 5 to 10, the apparatus is configured to transition from a first configuration (see, for example, FIG. 5) to a second configuration (see, for example, FIG. 6).

While the apparatus 200 is disposed in the first configuration, the sealed interface-effector 222 and the one-way valve 224 are co-operatively disposed such that the sealed interface-effector 222 is disposed between the housing passage 230 and the one-way valve 224, and the sealed interface effector 222 defines a sealed interface 222A between the housing passage 230 and the environment external to the housing 210 (i.e. the subterranean formation 100). It is understood that, with respect to the sealed interface 222A, although some leakage across the sealed interface 222A may be effectible, the rate of such leakage is sufficiently small so as not to adversely affect stimulation or production processes.

In some embodiments, for example, the flow controller 220 is defined within the communication passage 240. In this respect, in some embodiments, for example, each one of the sealed interface-effector 222 and the one-way valve 224, independently, is disposed within the communication passage 240.

While the apparatus 200 is disposed in the second configuration, (i) the sealed interface 222A is defeated, (ii) material flow is conductible, via the flow communicator 220, from the housing passage 230 to the environment external to the housing 210, in response to exceeding of fluid pressure, in the environment external to the housing 210, by fluid pressure within the housing passage 230, and (iii) the one-way valve is effective for preventing material flow, via the flow communicator 220, from the environment external to the housing 210 to the housing passage 230.

It is understood that, with respect to the sealed interface 222A, although some leakage across the sealed interface 222A may be effectible, the rate of such leakage is sufficiently small so as not to adversely affect stimulation or production processes.

It is understood that, while the apparatus is disposed in the second configuration, the one way valve effects sealing, or substantial sealing, of flow communication between the housing passage 230 and the environment external to the housing 210 (i.e. the subterranean formation 100), while the fluid pressure, in the environment external to the housing 210, is exceeding the fluid pressure within the housing passage 230, and, although some leakage may be present from the environment external to the housing 210 to the housing passage 230, the rate of such leakage is sufficiently small so as not to adversely affect stimulation or production processes.

In some embodiments, for example, while the apparatus 200 is disposed in the second configuration, the conducting of material flow, via the flow communicator 220, from the housing passage 230 to the environment external to the housing 210, in response to exceeding of fluid pressure, in the environment external to the housing 210, by fluid pressure within the housing passage 230, is only effectible when the exceeding is by at least a minimum pressure differential, and the minimum pressure differential is less than 250 psi. In some of these embodiments, for example, while the conducting of material flow, via the flow communicator 220, from the housing passage 230 to the environment external to the housing 210, is being effected, the one way valve 224 is disposed in the open condition. As a corollary, in some of these embodiments, for example, while the fluid pressure in the environment external to the housing 210 is exceeded by the fluid pressure within the housing passage 230 by less than the minimum pressure differential, or while the fluid pressure in the environment external to the housing 210 exceeds the fluid pressure within the housing passage 230, there is an absence of flow communication, via the flow communicator 220, between the environment external to the housing 210 and the housing passage 230. In this respect, while the apparatus 200 is disposed in the second configuration, fluid flow, via the flow communicator 220, from the environment external to the housing 210 to the housing passage 230 is prevented by the one-way valve 224. In some of these embodiments, for example, while the one way valve 224 is disposed in the closed condition, there is an absence of flow communication, via the flow communicator 220, between the environment external to the housing 210 and the housing passage 230.

With respect to the embodiments illustrated in FIGS. 5 to 10, the prevention of fluid flow, via the flow communicator 220 from the environment external to the housing 210 to the housing passage 230, by the one-way valve 224, prevents undesirable ingress of material into the housing passage 230 from the environment external to the housing 210, while the apparatus 200 is disposed in the second configuration (i.e. the configuration assumed after the sealed interface, originally defined by the sealed interface effector 222, has been defeated). In some embodiments, for example, it is desirable to prevent the ingress of material into the housing passage 230 from the environment external to the housing 210 for the purpose of mitigating an increase of wellhead pressure which could result in a blowout. In some embodiments, for example, where the material entering the housing passage 230 from the environment external to the housing 210 includes hydrocarbon material, preventing ingress of such material may be desirable for preventing the creation of explosive conditions.

With respect to the embodiments illustrated in FIGS. 5 to 10, the apparatus 200 is transitionable from the first configuration to the second configuration in response to disposition of the sealed interface-effector 222 in communication with a degradation-promoting agent. In this respect, the housing 210 and the sealed interface effector 222 are co-operatively configured such that, while the apparatus 200 is disposed in the first configuration, the sealed interface 222A, defined by the sealed interface effector 222, is defeatable in response to disposition of the sealed interface-effector 222 in communication with a degradation-promoting agent, with effect that the apparatus 200 becomes disposed in the second configuration. In response to disposition of the sealed interface-effector 222 in communication with a degradation-promoting agent, degradation of the sealed interface effector 222 is effected. In this respect, in some embodiments, for example, the sealed interface-effector 222 includes degradable material, and the degradation of the sealed interface effector 222 includes degradation of the degradable material, and the degradation is effected by, for example, at least one of dissolution and chemical conversion. In some embodiments, for example, the degradable material is degradable in response to contact with wellbore fluid, and, in this respect, the degradation-promoting agent is the wellbore fluid. In some embodiments, for example, the disposition of the sealed interface-effector 222 in communication with a degradation-promoting agent is effected by conducting the degradation-promoting agent downhole, from the surface 10, via the passage 106 of the wellbore string 104. In this respect, in such embodiments, for example, the apparatus 200 is transitionable from the first configuration to the second configuration in response to disposition of the sealed interface-effector 222 in communication with a degradation-promoting agent emplaced within the housing passage 230.

Figure 8:
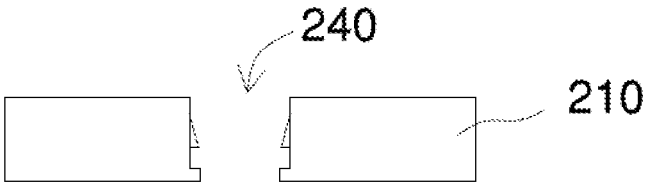
FIG. 8 is a partial side sectional view of the embodiment of the flow injection apparatus illustrated in FIG. 5, with the one-way valve having been removed from the apparatus.

With respect to the embodiments illustrated in FIGS. 5 to 10, in some embodiments, for example, the apparatus 200 is adapted for disposition in a third configuration. Referring to FIG. 8, in the third configuration, the preventing of material flow, via the flow communicator 220, from the environment external to the housing 210 to the housing passage 230, is defeated, with effect that flow communication is established, via the flow communicator 220 between the environment external to the housing 210 and the housing passage 230. In this respect, while the apparatus 200 is disposed in the third configuration, material flow is conductible, via the flow communicator 220, from the housing passage 230 to the environment external to the housing 210, and is also conductible, via the flow communicator 220, from the environment external to the housing 210 to the housing passage 230. To this end, while the apparatus 200 is disposed in the third configuration, hydrocarbon material is producible from the subterranean formation 100 via the flow communicator 220.

With respect to the embodiments illustrated in FIGS. 5 to 10, the apparatus 200 is transitionable from the second configuration to the third configuration in response to communication of a defeating stimulus to the one way valve 224. In this respect, the housing 210 and the sealed interface effector 222 are co-operatively configured such that, while the apparatus 200 is disposed in the second configuration, the preventing of material flow, via the flow communicator 220, from the environment external to the housing 210 to the housing passage 230, by the one way valve 224, is defeatable in response to communication of a defeating stimulus to the one way valve 224, with effect that the apparatus 300 becomes disposed in the third configuration. In some of these embodiments, for example, the defeating is with effect that the functionality of the one-way valve, relative to the apparatus, is defeated.

In some embodiments, for example, the defeating stimulus is a fluid pressure differential that is established by an exceeding of fluid pressure, in the environment external to the housing 210, by fluid pressure within the housing passage 230. In some embodiments, for example, the defeating stimulus is a fluid pressure differential that is established by an exceeding of fluid pressure, in the environment external to the housing 210, by fluid pressure within the housing passage 230, and the defeating of the preventing of material flow, via the flow communicator 220, from the environment external to the housing 210 to the housing passage 230, by the one way valve 224, is only effectible by the defeating stimulus when the exceeding is by at least a minimum pressure differential, and the minimum pressure differential is less than 250 psi.

In some embodiments, for example, the defeating stimulus is a degradation-promoting agent. In some embodiments, for example, the degradation promoting agent is a chemical agent, such as, for example, an acid. In this respect, in some embodiments, while the apparatus 200 is disposed in the second configuration, the housing 210 and the one way valve 224 are co-operatively configured such that the preventing of material flow, via the flow communicator 220, from the environment external to the housing 210 to the housing passage 230, by the one way valve 224, is defeatable in response to communication of the one way valve 224 with the degradation-promoting agent. In response to disposition of the one way valve 224 in communication with a degradation-promoting agent, degradation of the one way valve 224 is effected. In this respect, in some embodiments, for example, the one way valve includes degradable material, and the degradation of the one way valve 224 includes degradation of the degradable material, and the degradation is effected by, for example, at least one of dissolution and chemical conversion. In some embodiments, for example, the degradable material is a dissolvable metal material. In some embodiments, for example, the degradable material includes at least one of aluminium and magnesium. In some embodiments, for example, the degradable material is degradable in response to contact with wellbore fluid, and, in this respect, the degradation-promoting agent is the wellbore fluid. In some embodiments, for example, the disposition of the one way valve 224 in communication with a degradation-promoting agent is effected by conducting the degradation-promoting agent downhole, from the surface 10, via the passage 106 of the wellbore string 104.

In those embodiments where the defeating stimulus is a degradation-promoting agent, in some of these embodiments, for example, the defeating stimulus-defining degradation-promoting agent is different than the degradation-promoting agent that, in response to disposition of the sealed interface-effector 222 in communication with which, the apparatus 200 is transitionable from the first configuration to the second configuration.

In those embodiments where the defeating stimulus is a degradation-promoting agent, in some of these embodiments, for example, the defeating stimulus-defining degradation-promoting agent is the same as the degradation-promoting agent that, in response to disposition of the sealed interface-effector 222 in communication with which, the apparatus 200 is transitionable from the first configuration to the second configuration. In some of these embodiments, for example, the sealed interface-effector 222 and the one-way valve 224 are co-operatively configured such that, relative to degradation of the sealed interface-effector 222 in response to disposition of the sealed interface-effector 222 in communication with the degradation-promoting agent, the degradation of the one-way valve 224 in response to disposition of the one-way valve 224 in communication with the degradation-promoting agent is faster.

Figure 9:
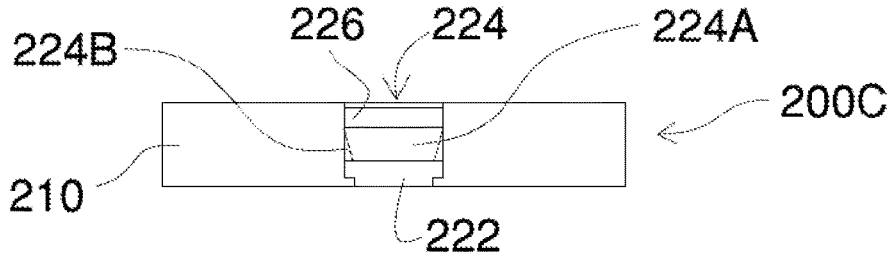
FIG. 9 is a partial side sectional view of another embodiment of a flow communication apparatus for use in the system illustrated in FIG. 1, illustrating the flow controller in the first configuration.
Figure 10:
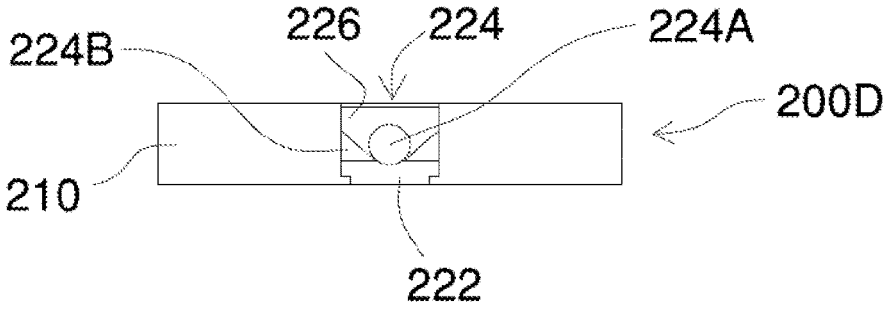
FIG. 10 is a partial side sectional view of another embodiment of a flow communication apparatus for use in the system illustrated in FIG. 1, illustrating the flow controller in the first configuration.

Referring to FIGS. 5-10, in some embodiments, for example, the one-way valve 224 includes a valve body 224A and a corresponding valve seat 224B for seating the valve body 224A, and the sealed interface-effector 222 and the one way valve 224 are disposed within the communication passage 240. Referring to FIGS. 5-9, in some embodiments, for example, the valve body 224A is defined by a disc. Referring to FIG. 10, in some embodiments, for example, the valve body 224A is defined by a ball.

With respect to those embodiments where the one-way valve 224 includes a valve body 224A and a valve seat 224B, and the sealed interface-effector 222 and the one way valve 224 are disposed within the communication passage 240, in some of these embodiments, for example, the sealed interface-effector 224 is defined by a plug. In some embodiments, for example, the plug 220 is received within the communication passage 240. In some embodiments, for example, the plug 220 is threadably coupled to the housing 210 within the communication passage 240. In some embodiments, for example, the plug 220 has a yield strength of at least 20,000 psi, such as, for example, at least 30,000 psi, such as, for example, at least 40,000 psi. In some embodiments, for example, the communication passage 240 has a maximum cross-sectional area of less than 50 square inches, such as, for example, less than 28 square inches.

With respect to those embodiments where the one-way valve 224 includes a valve body 224A and a valve seat 224B, and the sealed interface-effector 222 and the one way valve 224 are disposed within the communication passage 240. In some embodiments, for example, the seat 224B is defined by the housing 210.

With respect to those embodiments where the one-way valve 224 includes a valve body 224A and a valve seat 224B, and the sealed interface-effector 222 and the one way valve 224 are disposed within the communication passage 240, in some of these embodiments, for example, while: (i) the apparatus 200 is disposed in the second configuration (see FIG. 6), and (ii) the fluid pressure in the environment external to the housing 210 is exceeded by the fluid pressure within the housing passage 230 by less than a first minimum pressure differential, or while the fluid pressure in the environment external to the housing 210 exceeds the fluid pressure within the housing passage 230, the body 224A is urged to a seated position, whereby the body 224A is seated on the seat 224B, such that the one-way valve 224 is disposed in the closed condition. While the apparatus 200 is disposed in the second configuration, in response to fluid pressure within the housing passage 230 exceeding the fluid pressure in the environment external to the housing 210 (such as, for example, by at least the first minimum pressure differential, as described above), the body 224A becomes unseated (see FIG. 7). While the apparatus 200 is disposed in the second configuration, in response to fluid pressure within the housing passage 230 exceeding the fluid pressure in the environment external to the housing 210 (such as, for example, by at least a second minimum pressure differential), the body 224A is ejected from the communication passage 240, with effect that there is an absence of interference of the communication passage 240, such that the apparatus 200 becomes disposed in the third configuration (see FIG. 8). In some of these embodiments, for example, the first minimum pressure differential is different than the second minimum pressure differential. In some of these embodiments, for example, the first minimum pressure differential is the same as the second minimum pressure differential. In some of these embodiments, for example, the transitioning of the apparatus 200 from the first configuration to the second configuration to the third configuration is continuous, such that the second configuration is an intermediate transitory state, and is effected in response to a pressure differential, between the housing passage 230 and the environment external to the housing 210, that remains established throughout the transitioning.

Referring to FIGS. 9 and 10, in some embodiments, for example, a cement retardant 226 is disposed within the communication passage 240 for preventing ingress of cement into the communication passage 240 during cementing.

In some embodiments, for example, the flow communication station 114 functions as a toe initiator station, and each one of the one or more flow communication apparatuses 200, independently, function as toe initiators. In some embodiments, for example, the flow communication station 114 includes a plurality of such flow initiators. In some embodiments, for example, the plurality of flow initiators are spaced apart relative to one another. In some embodiments, for example, the plurality of flow initiators are axially spaced apart relative to one another. In this respect, fluid is conductible through an opened flow communicator 220, (i.e. once the sealed interface defined by the sealed interface effector 224 has been defeated) for purposes of, for example, deploying tools downhole.

In some embodiments, for example, the flow communication apparatus 200 functions to inject treatment material into the subterranean formation 100 for effecting conditioning of the subterranean formation 100 for hydrocarbon production through an opened flow communicator 220, (i.e. once the sealed interface defined by the sealed interface effector 224 has been defeated). For the embodiments illustrated in FIGS. 2-4, the flow communication apparatus 200 would be effective to inject treatment material while disposed in the first configuration. For the embodiments illustrated in FIGS. 5-10, the flow communication apparatus 200 would be effective to inject treatment material while disposed in the second or third configurations. In some embodiments, for example, for effecting the injection of treatment material via the flow communication apparatus 200, the flow communication apparatus 200 is integrated within a straddle packer system.

In some embodiments, for example, the flow communication apparatus 200 functions to receive hydrocarbon production through an opened flow communicator. For the embodiments illustrated in FIGS. 2-4, the flow communication apparatus 200 would be effective to receive hydrocarbon production while disposed in the first configuration. For the embodiments illustrated in FIGS. 5-10, the flow communication apparatus 200 would be effective to receive hydrocarbon production while disposed in the third configuration. In some embodiments, for example, for effecting the production of hydrocarbon material from a subterranean formation via the flow communication apparatus 200, the flow communication apparatus 200 is integrated within a straddle packer system.

Although the embodiments have been described in detail, it should be understood that various changes, substitutions and alterations can be made herein. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be examples only. The invention is defined by the appended claims.

The invention claimed is:

1. A fluid flow conducting apparatus comprising:

a housing;

a flow communicator disposed on an external surface of the housing;

a housing passage configured for conducting fluid through the housing;

a communication passage extending through the housing from the flow communicator to the housing passage; and a flow controller disposed within the communication passage and configured for controlling flow communication, via the flow communicator, between the housing passage and an environment external to the housing, the flow controller including:

a sealed interface-effector; and a one-way valve;

wherein:

the sealed interface-effector and the one-way valve are co-operatively configured such that the flow controller is disposed in a first configuration, and adapted for disposition in a second configuration in response to disposition of the sealed interface-effector in communication with a degradation-promoting agent such that degradation of the sealed interface effector is effected;

in the first configuration, the sealed interface effector defines a sealed interface between the housing passage and the environment external to the housing; and in the second configuration, the sealed interface is defeated and the one-way valve and the housing passage are co-operatively configured such that, while the one-way valve is disposed in an open condition, flow communication between the housing passage and the environment external to the housing is established.

2. The fluid flow conducting apparatus as claimed in claim 1;

wherein:

the disposition of the sealed interface-effector in communication with a degradation-promoting agent includes disposition of the sealed interface-effector in communication with a degradation-promoting agent emplaced within the housing passage.

3. The fluid flow conducting apparatus as claimed in any one of claim 1;

wherein:

the sealed interface-effector includes degradable material.

4. The fluid flow conducting apparatus as claimed in claim 3;

wherein:

the degradable material includes a dissolvable metal.

5. The fluid flow conducting apparatus as claimed claim 1;

wherein:

the sealed interface effector is defined by a plug that is disposed within the communication passage such that the sealed interface-effector is disposed intermediate the housing passage and the one-way valve.

6. The fluid flow conducting apparatus as claimed in claim 5;

wherein:

the communication passage has a maximum cross-sectional area of less than four (4) square inches.

7. The fluid flow conducting apparatus as claimed in claim 5;

wherein:

the plug has a yield strength of at least 20,000 psi.

8. The fluid flow conducting apparatus as claimed in claim 1;

wherein:

in the second configuration, disposition of the one-way valve in the open condition is effected in response to exceeding of fluid pressure, in the environment external to the housing, by fluid pressure within the housing passage, by at least a minimum pressure differential, wherein the minimum pressure differential is less than 250 psi.

9. The fluid flow conducting apparatus as claimed in claim 1;

wherein:

in the first configuration, the sealed interface effector is threadably coupled within the communication passage.

10. The fluid flow conducting apparatus as claimed in claim 1;

wherein:

in the second configuration, the one-way valve is effective for preventing fluid flow from the environment external to the housing to the housing passage, via the communication passage.

11. The fluid flow conducting apparatus as claimed in claim 1;

wherein:

the flow controller is adapted for disposition in a third configuration in response to defeating of the one-way valve such that flow communication from the environment external to the housing to the housing passage, via the communication passage, is permitted.

12. The fluid flow conducting apparatus as claimed in claim 11;

wherein:

the defeating of the one-way valve is in response to communication of a defeating stimulus to the one-way valve.

13. The fluid flow conducting apparatus as claimed in claim 12;

wherein:

the defeating stimulus is a fluid pressure differential that is established by exceeding of fluid pressure, in the environment external to the housing, by fluid pressure within the housing passage, by at least a minimum pressure differential, wherein the minimum pressure differential is less than 250 psi.

14. The fluid flow conducting apparatus as claimed in claim 12;

wherein:

the one-way valve includes degradable material; and the defeating stimulus is a degradation-promoting agent disposed in communication with the one-way valve via emplacement of the degradation-promoting agent within the housing passage.

15. The fluid flow conducting apparatus as claimed in claim 14;

wherein:

the degradation-promoting agent effective for transitioning the flow controller from the second configuration to the third configuration is different than the degradation-promoting agent that is effective for transitioning the flow controller from the first configuration to the second configuration.

16. The fluid flow conducting apparatus as claimed in claim 14;

wherein:

the degradation-promoting agent effective for transitioning the flow controller from the second configuration to the third configuration is the same as the degradation-promoting agent that is effective for transitioning the flow controller from the first configuration to the second configuration.

17. The fluid flow conducting apparatus as claimed in claim 14;

wherein:

the sealed interface-effector and the one-way valve are co-operatively configured such that, relative to degradation of the sealed interface-effector in response to disposition of the sealed interface-effector in communication with the degradation-promoting agent, the degradation of the one-way valve, in response to disposition of the one-way valve in communication with the degradation-promoting agent, is faster.

18. The fluid flow conducting apparatus as claimed in claim 12;

wherein:

the communication of the defeating stimulus to the one-way valve is with effect that the one-way valve is ejected from the communication passage such that there is an absence of interference to conducting of fluid flow from the environment external to the housing to the housing passage via the communication passage.

19. A fluid flow conducting apparatus comprising:

a housing;

a housing passage configured for conducting fluid through the housing; and a flow controller for controlling flow communication between the housing passage and an environment external to the housing, and including a sealed interface-effector and a one-way valve;

wherein:

the flow controller is disposed in a first configuration, and adapted for disposition in a second configuration in response to disposition of the sealed interface-effector in communication with a degradation-promoting agent such that degradation of the sealed interface effector is effected; and the sealed interface-effector and the one-way valve are co-operatively disposed such that:

in the first configuration, the sealed interface effector defines a sealed interface between the housing passage and the one-way valve such that there is an absence of flow communication between the housing passage and the one-way valve such fluid flow from the housing to the environment external to the housing is prevented; and in the second configuration, the sealed interface is defeated with effect that: (i) while the one-way valve is disposed in an open configuration, flow communication between the housing passage and the environment external to the housing is established such that fluid flow is conductible from the housing passage to the environment external to the housing, and (ii) the one-way valve is effective for preventing fluid flow from the environment external to the housing to the housing passage.

20. The fluid flow conducting apparatus as claimed in claim 19;

wherein:

the disposition of the sealed interface-effector in communication with a degradation-promoting agent includes disposition of the sealed interface-effector in communication with a degradation-promoting agent emplaced within the housing passage.

21. The fluid flow conducting apparatus as claimed in claim 19;

wherein:

the sealed interface-effector includes a plug, and the plug includes degradable material.

22. The fluid flow conducting apparatus as claimed in claim 21;

wherein:

the degradable material includes a dissolvable metal.

23. The fluid flow conducting apparatus as claimed in claim 19;

wherein:

in the second configuration, disposition of the one-way valve in the open condition is effected in response to exceeding of fluid pressure, in the environment external to the housing, by fluid pressure within the housing passage, by at least a minimum pressure differential, wherein the minimum pressure differential is less than 250 psi.

24. The fluid flow conducting apparatus as claimed in claim 19;

wherein:

in the first configuration, the sealed interface effector is threadably coupled to the housing.

25. The fluid flow conducting apparatus as claimed in claim 19;

wherein:

the sealed interface effector includes a plug; and the plug has a yield strength of at least 20,000 psi.

26. The fluid flow conducting apparatus as claimed in claim 19;

wherein:

the flow controller is adapted for disposition in a third configuration in response to defeating of the one-way valve such that fluid flow is conductible from the environment external to the housing to the housing passage.

27. The fluid flow conducting apparatus as claimed in claim 26;

wherein:

the defeating of the one-way valve is in response to communication of a defeating stimulus to the one-way valve.

28. The fluid flow conducting apparatus as claimed in claim 27;

wherein:

the defeating stimulus is a fluid pressure differential that is established in response to exceeding of fluid pressure, in the environment external to the housing, by fluid pressure within the housing passage, by at least a minimum pressure differential, wherein the minimum pressure differential is less than 250 psi.

29. The fluid flow conducting apparatus as claimed in claim 28;

wherein:

the communication of the defeating stimulus to the one-way valve is with effect that the one-way valve is ejected from the communication passage such that fluid flow is conductible from the environment external to the housing to the housing passage.

30. The fluid flow conducting apparatus as claimed in claim 27;

wherein:

the one-way valve includes degradable material; and the defeating stimulus is a degradation-promoting agent disposed in communication with the one-way valve via emplacement of the degradation-promoting agent within the housing passage.

31. The fluid flow conducting apparatus as claimed in claim 30;

wherein:

the degradation-promoting agent effective for transitioning the flow controller from the second configuration to the third configuration is different than the degradation-promoting agent that is effective for transitioning the flow controller from the first configuration to the second configuration.

32. The fluid flow conducting apparatus as claimed in claim 30;

wherein:

the degradation-promoting agent effective for transitioning the flow controller from the second configuration to the third configuration is the same as the degradation-promoting agent that is effective for transitioning the flow controller from the first configuration to the second configuration.

33. The fluid flow conducting apparatus as claimed in claim 30;

wherein:

the sealed interface-effector and the one-way valve are co-operatively disposed such that, relative to degradation of the sealed interface-effector in response to disposition of the sealed interface-effector in communication with the degradation-promoting agent, the degradation of the one-way valve in response to disposition of the one-way valve in communication with the degradation-promoting agent is faster.

34. The fluid flow conducting apparatus as claimed in claim 19;

wherein:

the housing includes a communication passage extending between a flow communicator disposed on an external surface of the housing and the housing passage; and the sealed interface-effector and the one-way valve are disposed within the communication passage.

* * * * *